US012310466B2

(12) United States Patent
Koçhisarli

(10) Patent No.: US 12,310,466 B2
(45) Date of Patent: May 27, 2025

(54) JEWELRY MODULE

(71) Applicant: Can Koçhisarli, Istanbul (TR)

(72) Inventor: Can Koçhisarli, Istanbul (TR)

( * ) Notice: Subject to any disclaimer, the term of this patent is extended or adjusted under 35 U.S.C. 154(b) by 0 days.

(21) Appl. No.: 18/551,231

(22) PCT Filed: Oct. 4, 2022

(86) PCT No.: PCT/TR2022/051081
§ 371 (c)(1),
(2) Date: Sep. 19, 2023

(87) PCT Pub. No.: WO2023/224583
PCT Pub. Date: Nov. 23, 2023

(65) Prior Publication Data

US 2025/0031812 A1 Jan. 30, 2025

(30) Foreign Application Priority Data

May 18, 2022 (TR) ..... 2022/008088

(51) Int. Cl.
*A44C 5/10* (2006.01)
*A44C 13/00* (2006.01)
*A44C 17/02* (2006.01)

(52) U.S. Cl.
CPC ..... *A44C 5/102* (2013.01); *A44C 17/02* (2013.01)

(58) Field of Classification Search
CPC ..... A44C 13/00; A44C 17/02; A44C 17/0258; A44C 5/102; A44C 5/105; A44C 11/007
USPC ..... 59/80, 82
See application file for complete search history.

(56) References Cited

U.S. PATENT DOCUMENTS 1,153,362 A * 9/1915 Wacha ..... A44C 11/007 63/4
D317,139 S * 5/1991 Chia ..... D11/93
5,285,659 A 2/1994 Bardisbanyan
8,061,160 B2 11/2011 Stinespring
(Continued)

FOREIGN PATENT DOCUMENTS

KR 101639679 B1 7/2016
TR 2006/02420 B 5/2006
(Continued)

OTHER PUBLICATIONS

International Search Report for corresponding PCT/TR2022/051081 dated Jan. 6, 2023.
(Continued)

*Primary Examiner* — Jack W Lavinder
(74) *Attorney, Agent, or Firm* — Egbert, McDaniel & Swartz, PLLC

(57) ABSTRACT

Disclosed is a jewelry module in which each core module is formed by connecting each other in jewelry produced by processing precious metals. The jewelry module has a rotation bed having an axis of rotation formed so as to be centered on the joining axis of each core module. Additionally, an angle of rotation with a reduced distance away from the rotational movement of each core module by the presence of said axis of rotation is provided, and a connection bracket is centered on the axis of rotation, which grasps the rotation bed and enables one core module to be connected with the other core module.

7 Claims, 4 Drawing Sheets

(56) References Cited

U.S. PATENT DOCUMENTS

| | | | | |
|---|---|---|---|---|
| 8,156,759 | B2 * | 4/2012 | Nevatia | A44C 5/102 63/3 |
| D873,703 | S * | 1/2020 | Borsari | D11/86 |
| 2004/0103689 | A1 * | 6/2004 | Chia | A44C 11/007 63/26 |
| 2008/0110204 | A1 * | 5/2008 | Suen | A44C 5/102 24/318 |

FOREIGN PATENT DOCUMENTS

| | | | |
|---|---|---|---|
| TR | 2008/02006 | U | 3/2008 |
| WO | 2020036240 | A1 | 2/2020 |

OTHER PUBLICATIONS

Written Opinion of the International Searching Authority for corresponding PCT/TR2022/051081 dated Jan. 6, 2023.

* cited by examiner

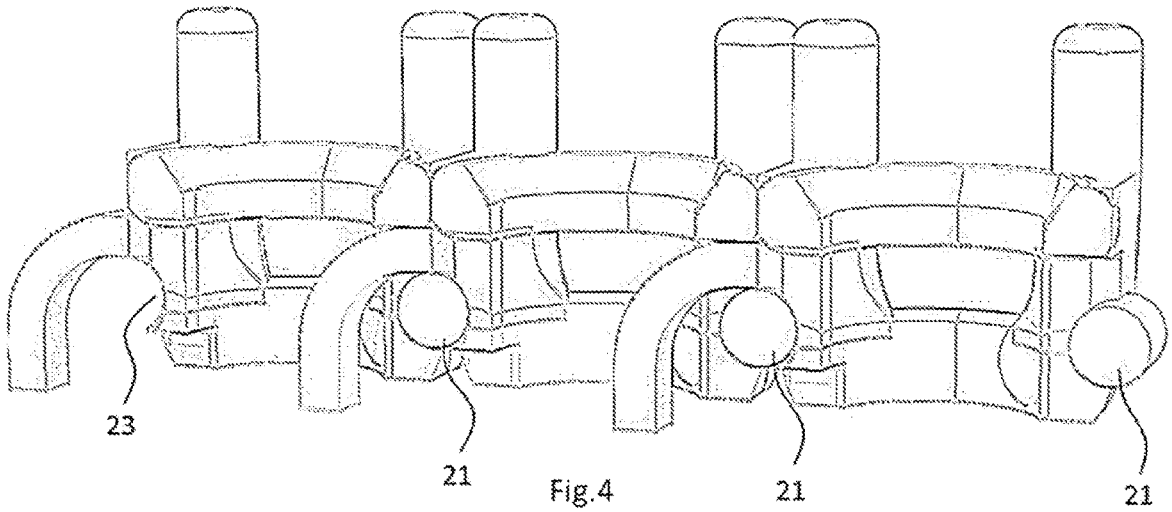
Fig.4
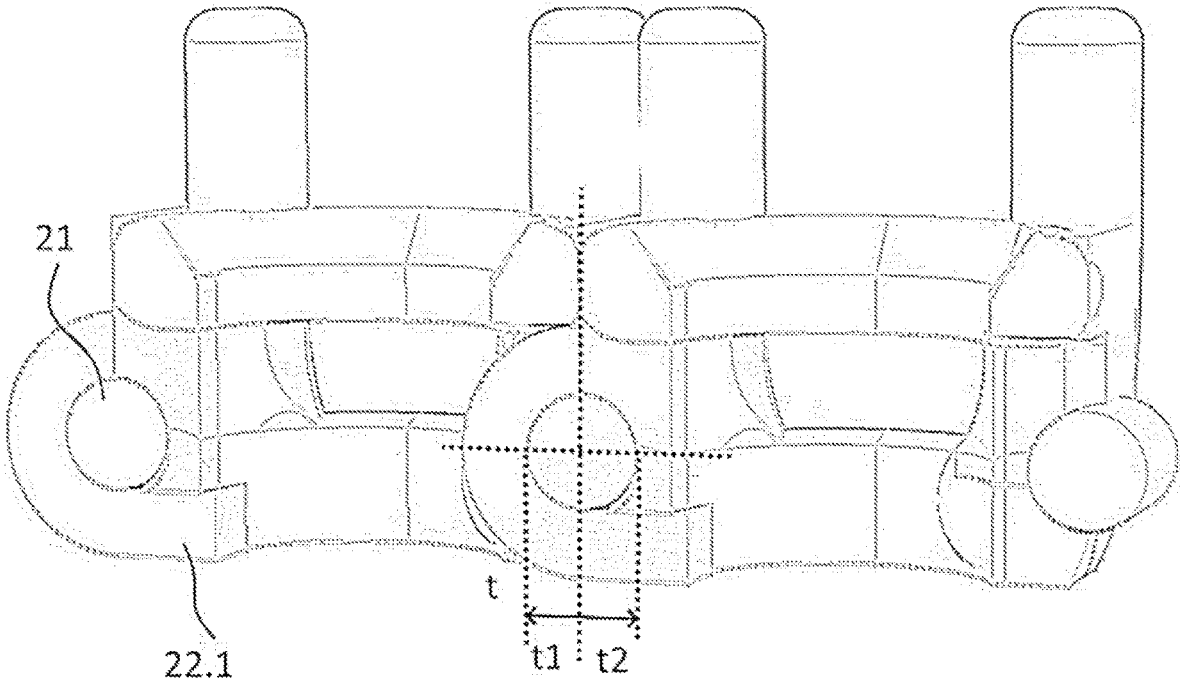
Fig. 4.1

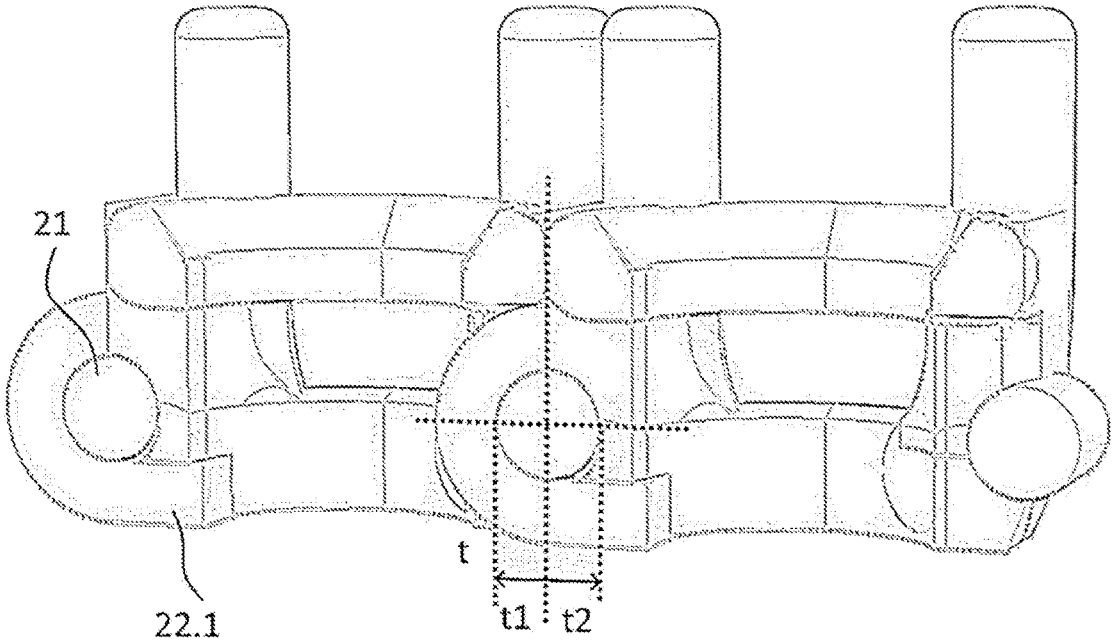
Fig. 4.2
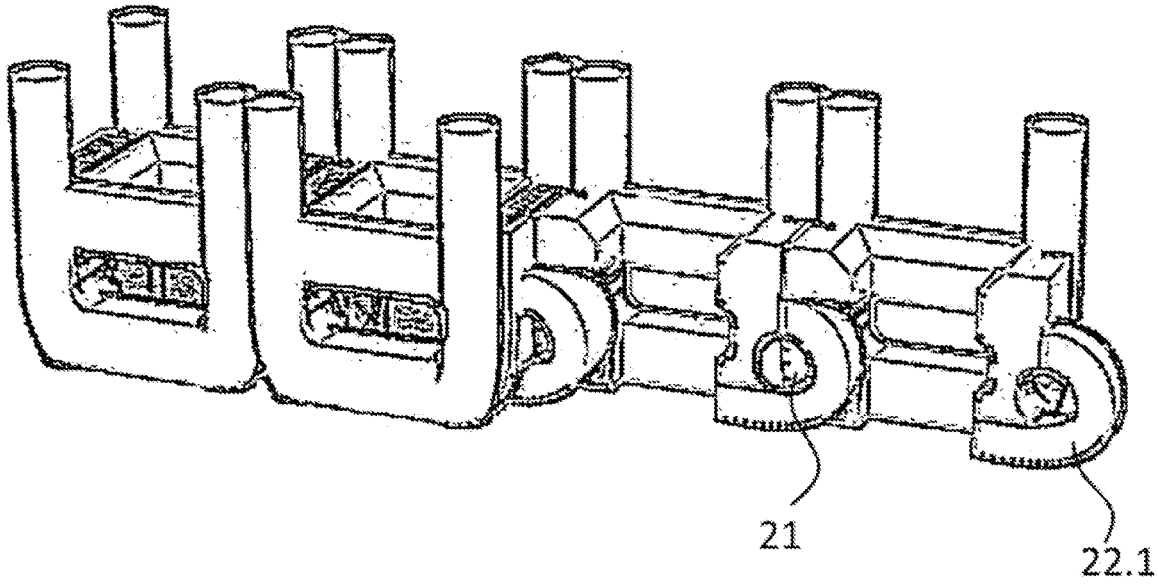
Fig. 4.3

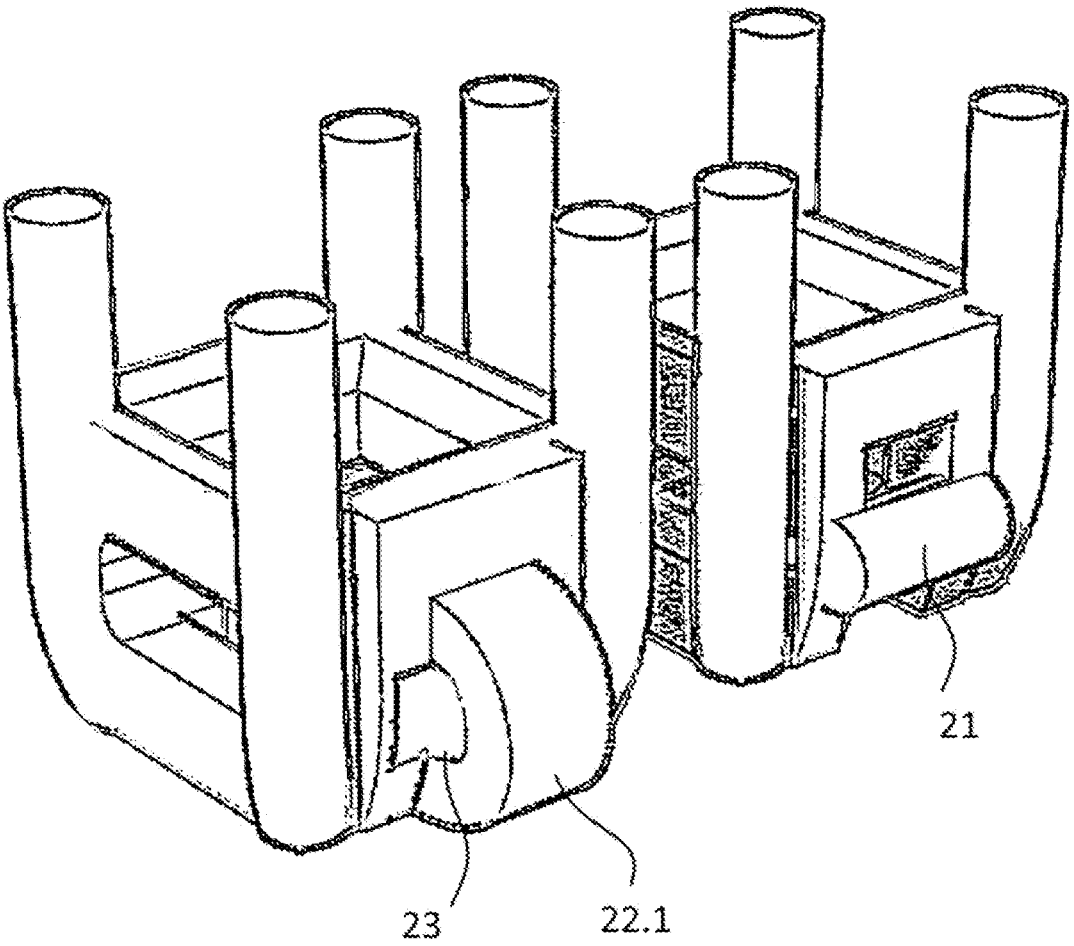
Fig. 4.4

JEWELRY MODULE

TECHNICAL FIELD

The invention relates to precious metals and valuable ornaments or precious jewelry in which these precious metals are processed and turned into jewelry.

The said invention relates to a jewelry module with increased mobility, used to join the jewelry parts together in jewelry having more than one piece combined by methods known as chain or soutache, which allows the jewelry parts to become a closed circle without deformation

PRIOR ART

Today, jewelry produced from precious metals has an important place for men and women. In the said jewelry industry, necklaces, pendants and bracelets are of high importance for their visual appeal and design, as well as robustness, ease of use and lightness Especially jewelry such as necklaces, pendants and bracelets, which consist of more than one piece, are used very often today. For this reason, stable and good circular mobility between the parts (within acceptable conditions) as well as the strength lightness and therefore low cost are preferred in these jewelry. Many traditional techniques are currently applied to produce these jewelry.

In the present traditional technique today, the joining of the two parts is made by engaging a monolithic pin in the first part and a bracket formed in the second part so as to grasp this pin. Here, since the pin is not in the common center of balance of the two parts, a gap is formed between the two parts in the jewelry, which causes an unpleasant appearance. In addition to this, the jewelry begins to loosen over time due to its mobility and begins to disintegrate due to this loosening.

Another traditional technique used today is the hinge technique on the doors. In this technique, the cylinder on the second part is placed in the space disposed in the first part and a pin is passed through the gap in this combination and this pin is welded from the two outer surfaces of the jewelry. This technique is suitable for mobility and robustness, but due to the excess of workload and materials used, the jewelry has a high weight and high cost. The multi-piece jewelry produced in existing traditional techniques have production costs and have less durability.

According to the research we have conducted in the Turkish patent database, an application numbered 2006/02420 was found. The summary page of this application describes the invention as follows: The invention is a functional women's necklace wherein it comprises single stone mounting holes, charnel, channel, earring wire, tabs, chain, teardrop, ring, spot, main part, separable parts and tongue and the parts separated from it can be used as earrings.

According to the research we have conducted in the Turkish patent database, an application numbered 2008/02006 was found. The summary page of this application describes the invention as follows: The invention is a functional women's necklace wherein it can be separated into independent parts and the separated parts can be used as a pair of women's earrings.

According to the research we have conducted in the US patent database, an application numbered U.S. Pat. No. 8,061,160B2 was found. The summary page of this application describes the invention as follows: The invention relates to an adjustable fashion mechanism for jewelry, clothing and fashion accessories, and more specifically an adjustable mechanism that allows the dimensions of jewelry, clothing and accessories to be adjusted to suit people of various different sizes.

According to the research we have conducted in the US patent database, an application numbered U.S. Pat. No. 8,061,160B2 was found. The summary page of this application describes the invention as follows: The invention relates to jewelry more specifically rings, bracelets, necklaces and other decorative tapes, with a flexible ring structure made of loosely attached prisms that define an internal channel,

DESCRIPTION OF THE INVENTION

The objective of the invention is to provide a jewelry module in which the distance between the two core modules is reduced by the center of rotation disposed in the middle of each core module that makes up the jewelry module.

The most important objective of the invention is to ensure the balanced movement of the jewelry module in the x-x1 rotational direction with the core module, and to prevent the wobbling of the jewelry (off-axis movements) by means of the rotation bed in case an external force is applied.

Another important objective of the invention is to reduce the distance between the two parts as the rotation axis is formed in the middle of the two core modules. Thus, it is the objective of the invention to provide a jewelry with a high visual appeal, in which a rigid use and aesthetic appearance are preserved.

The most important objective of the invention is to provide a low-cost product that provides material savings and ease of production with its monolithic structure.

Another objective of the invention is to provide a lighter and more rigid product compared to the currently used jewelry modules.

The important objective of the invention is to eliminate product deformations that may occur due to use by ensuring that the two modules are combined in a balanced way.

Another important objective of the invention is to provide a product with mobility that will not cause product deformation due to use over time compared to the currently used jewelry modules.

Another objective of the invention is to provide jewelry that is more robust, lightweight and long-lasting compared to existing jewelry.

In order to achieve the objectives described above, the invention is a jewelry module in which each core module is formed by connecting each core module to each other in the jewelry produced by processing precious metals, wherein the said module comprises;

- a rotation bed with a rotational axis formed at the center the junction axis of each of the said core modules,
- an angle of rotation with reduced distance by rotational movement of each core module with the presence of the said axis of rotation,
- a pin space that allows the combination of two jewelry modules formed on the inside of the core module in such a way as to provide rigid movement in x-x1 rotational movement in such a way that the outer part of the said rotation bearing can be accommodated
- a connection bracket centered on the rotational axis that engages the said rotation bearing, allowing one core module to be joined with the other core module in such a way that they cannot be separated from each other.

DESCRIPTION OF THE FIGURES

FIG. 4 is a two-dimensional representative view of the core modules that make up the jewelry module, showing the axis of rotation, with the bending end open FIG. 4.1 is another representative view showing the axis of rotation of the core modules that make up the jewelry module with the bending end bent FIG. 4.2 is a representative two-dimensional view showing the angle of rotation.

FIG. 4.3 is a cross-sectional representative two-dimensional view showing the angle of rotation.

FIG. 4.4 is a representative view of the core modules that make up the jewelry module, with the bending end open and closed.

PART NUMBERS

10—Jewelry module
20—Core module
21—Rotation bed
22—Connection bracket
22.1 Bending end
23—Pin space
24—Joining space
25—Fixer
26—Mounting gap
30—Precious stone
A—Viewing direction
B—Center of rotation
C—Joining axis
D—Angle of rotation
x, x1—Direction of rotation
t—Full length
t1—Half length
t2—Other half length

DETAILED DESCRIPTION OF THE INVENTION

Figure 1:
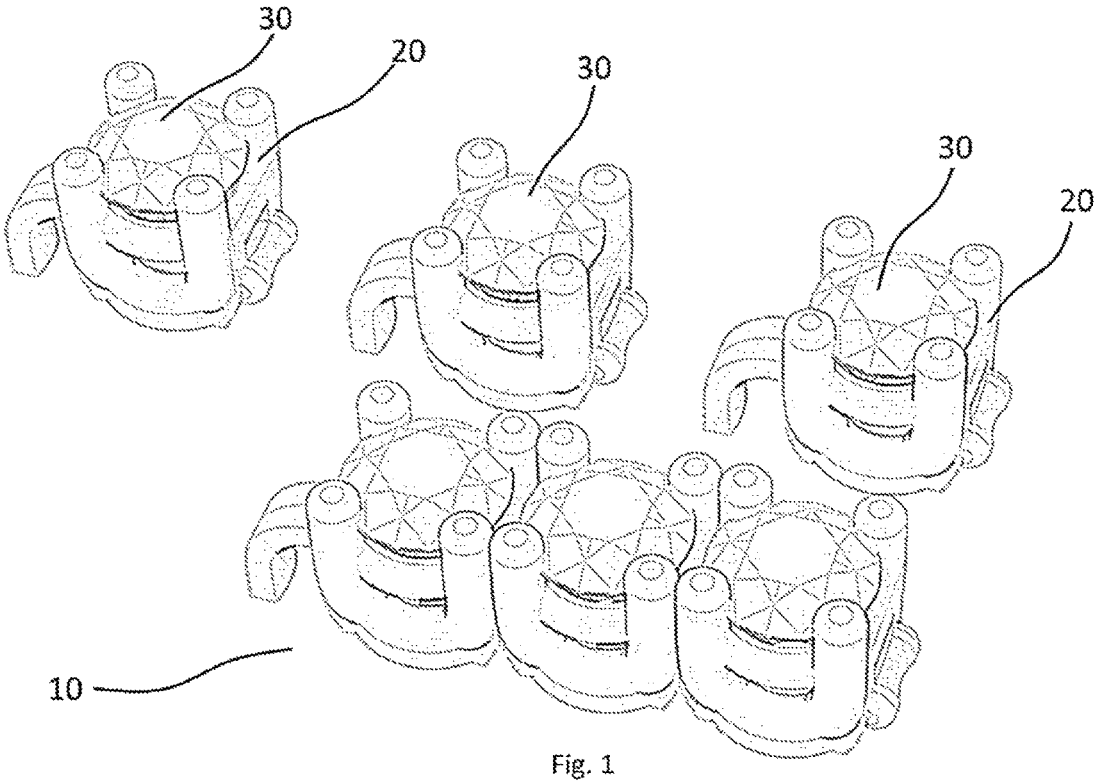
FIG. 1 is the perspective view of the general assembly and disassembly of the jewelry module, which is the subject of the invention.
Figure 2:
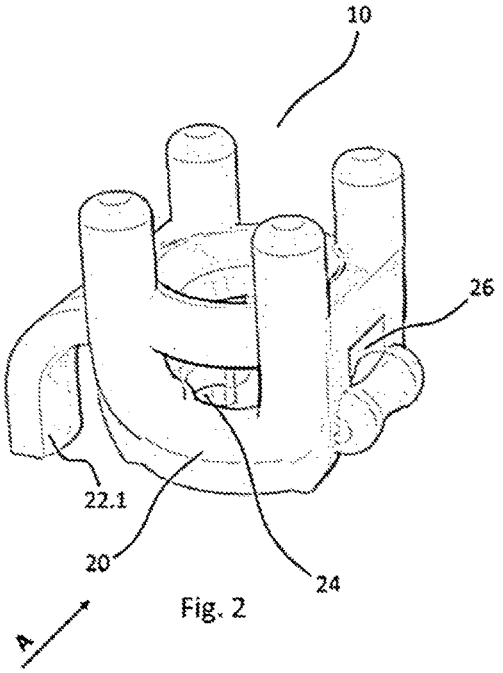
FIG. 2 is the three-dimensional individual perspective view of the jewelry module, which is the subject of the invention.
Figure 3:
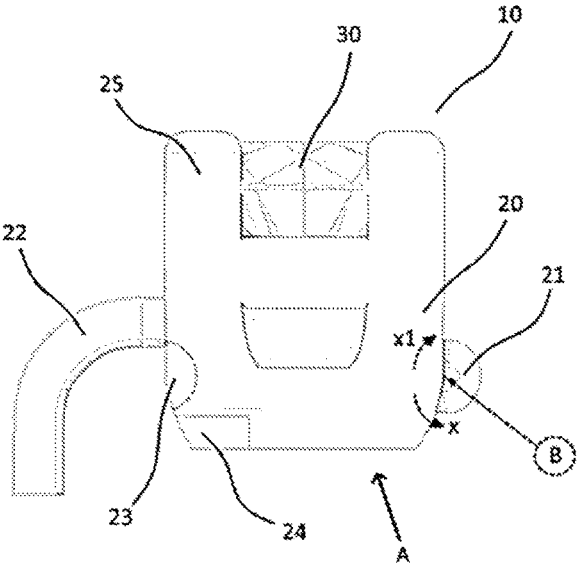
FIG. 3 is the two-dimensional view of the jewelry module, which is the subject of the invention, from the A direction.

FIG. 1 illustrates a jewelry module (10) in which each core module (20) is connected to each other in jewelry produced by processing precious metals.

FIGS. 4, 4.1 and 4.2 shows the rotation bearing (21) with a rotation axis (B) formed to be centered at the junction axis (C) of each core module (20) and with the presence of the said rotation axis (B), the rotation angle (D) of each core module (20) is obtained with a reduced distance of departure is obtained by the rotational movement. Thus, the rotation angle (D) between both core modules (20) is reduced. Due to the fact that this rotation angle (D) is much higher than the acceptable dimensions in the present technique, an appearance is formed in the axial rotation of the core modules (20) that disturbs the aesthetic appearance.

The semicircular pin space (23) in which the semi-circular part of the said rotation bearing (21) will be positioned, and the rotation bearing (21) centered on the rotation axis (B) that enables a core module (20) to be connected with the other core module (20) by grasping the said rotation bearing (21) includes the connecting bracket (22). Likewise, it comprises a rotation axis (B) with half length (t1) and other half length (t2) equal to each other, configured to be exactly in the middle of each core module (20) by placing two core modules (20) side by side. (see FIG. 4.1).

In case an external force is applied, jewelry wobble (off-axis movements) is prevented by means of the rotation bed (21) by ensuring the balanced movement of the jewelry module (10) in the x-x1 direction of rotation in a monolithic structure with the said core module (20). However, the said core module (20) contains a pin space (23), which is formed in the inner part of the core module (20) in such a way that the adjacent jewelry modules (10), which are formed in such dimensions that the rotation bed (21) can be placed, are rigidly joined in such a way as to ensure their movement in the x-x1 direction of rotation. In addition, the jewelry module (10) includes a connection bracket (22), which grasps the said rotation bed (21) and enables one jewelry module (10) to be joined with another jewelry module (10) in such a way that they cannot be separated from each other, and a joining space (24), which enables the connection bracket (22) to be placed and welded into it by bending during the joining of the jewelry modules (10). In addition, it has a center of rotation (B), which is positioned as a common balance point of adjacent jewelry modules (10) side by side in the combination of jewelry modules (10) and enables the movement of jewelry modules (10) in x-x1 directions without damaging each other.

On the other hand, the jewelry module (10) is formed in a monolithic structure with the core module (20) in such a way that the aforementioned connection bracket (22) can pass through it and the mounting gap (26) is formed to allow the jewelry module (10) to move in the x-x1 directions. This core module (20) is formed in a monolithic structure with the module (10), and includes a fixer (25) for fixing the precious stones (30) mounted on the jewelry module (10).

The inventive jewelry module (10) includes a core module (20), and comprises a rotation bed (21), a connection bracket (22), a pin space (23). The connection bracket (22) of one said jewelry module (10) is passed through the mounting gap (26) so as to engage the rotation bed (21) of another jewelry module (10). The connection bracket (22) is bent by means of a force, inserted into the joining space (24) of its own jewelry module (10) and welded. Simultaneously with this process, the rotation bed (21) of the first jewelry module (10) is inserted into the pin space (23) of the other jewelry module (10). Moreover, this connection is made especially thanks to the center of rotation (B) so that both jewelry modules (10) are balanced and can rotate freely in the x-x1 directions of rotation. After the bending end (22.1) is inserted into the rotation bed (21), it is bent into a rotational movement.

Thus, when a force is applied to a piece of jewelry made of the aforementioned jewelry modules (10) to twist the jewelry, there is no twisting or wobbling of the jewelry due to the combination of the rotation bed (21) and the pin space (23) at the center of rotation (B).

The invention claimed is:

1. A jewelry module comprising:

a plurality of core modules each being of a monolithic structure, each of said plurality of core modules being connected to at least one other core module of said plurality of core modules, each of said plurality of core modules being formed of a processed precious metal;

a rotation bed positioned on each of said plurality of core modules, said rotation bed having a central rotation axis along a joining axis, said rotation bed allowing symmetrical movement while preventing lateral movement of each of said plurality of core modules, wherein an angle of rotation is formed by a displacement between adjacent core modules of said plurality of core modules during rotational movement around the central rotation axis, a semicircular pin space being formed within each core module of said plurality of core modules, the semicircular pin space dimensioned to receive an outer semicircular portion of said rotation bed; and a connection bracket positioned about the central rotation axis, said connection bracket interlocking with said rotation bed via a joining space, wherein the rotation bed prevents deviations from the central rotation axis, the interlocking of said connection bracket eliminating gaps between said plurality of core modules.

2. The jewelry module of claim 1, wherein the central rotation axis extends symmetrically along an entire length of the jewelry module, the entire length being divided into a first half length and a second half length, wherein the central rotation axis is positioned centrally along the joining axis within each core module of said plurality of core modules.

3. The jewelry module of claim 1, wherein said rotation bed is a monolithic structure and is adapted to balance movement of said plurality of core modules along a direction of rotation and to prevent lateral movement in response to external forces.

4. The jewelry module of claim 3, wherein each core module of said plurality of core modules has mounting gap therein so as to allow said connection bracket to move in a circular path along the direction of rotation.

5. The jewelry module of claim 1, wherein each core module of said plurality of core modules has a joining space that accommodates a bending and securing of said connection bracket.

6. The jewelry module of claim 1, wherein each core module of said plurality of core modules has a fixer formed integrally therewith, the fixer adapted to secure a precious stone mounted on the jewelry module.

7. The jewelry module of claim 1, wherein said connection bracket has a bending end that engages said joining space by wrapping around a surface of the rotation bed, the bending end being bent so as to secure the rotation movement of said plurality of core modules.

* * * * *